United States Patent [19]

Rickard

[11] 4,084,476

[45] Apr. 18, 1978

[54] REINFORCED STRINGED MUSICAL INSTRUMENT NECK

[75] Inventor: James H. Rickard, Harwinton, Conn.

[73] Assignee: Ovation Instruments, Inc., New Hartford, Conn.

[21] Appl. No.: 699,869

[22] Filed: Jun. 25, 1976

[51] Int. Cl.[2] ..... G10D 3/00

[52] U.S. Cl. ..... 84/293

[58] Field of Search ..... 84/293

[56] References Cited

U.S. PATENT DOCUMENTS

| | | | |
|---|---|---|---|
| 2,460,943 | 2/1949 | Nelson | 84/293 |
| 3,244,054 | 4/1966 | Berglund | 84/293 |
| 3,417,646 | 12/1968 | Cookerly et al. | 84/293 |
| 3,474,697 | 10/1969 | Kaman | 84/293 X |
| 3,538,807 | 11/1970 | Francis | 84/293 |

*Primary Examiner*—Lawrence R. Franklin

*Attorney, Agent, or Firm*—McCormick, Paulding & Huber

[57] ABSTRACT

A neck for a guitar or other stringed musical instrument includes a body of wood, structural foamed plastic or the like and at least one reinforcing member strengthening and stiffening the body. This reinforcing member is one having a high modulus of elasticity and is spaced from the neutral axis of the remainder of the neck so as to effectively resist bending of the neck under string tension.

19 Claims, 15 Drawing Figures

REINFORCED STRINGED MUSICAL INSTRUMENT NECK

BACKGROUND OF THE INVENTION

This invention relates to stringed musical instruments of the type, such as guitars, having an elongated neck along which extends a set of strings, and deals more particularly with a neck for such an instrument which is strengthened and stiffened to resist bending under string and other forces imposed thereon and to achieve other advantages.

The invention of this application may be applied to any stringed musical instrument of the type having a bridge, tailpiece or other anchor, and an elongated neck along which a set of strings, fixed to the tailpiece and passing over the bridge, extend to a nut and pegboard or the like at the outer end of the neck, the neck also serving by itself as a, or carrying a separate, fretted or unfretted fingerboard against which the strings are stopped to vary their lengths and consequently the pitch of the musical tones produced thereby. Examples of such instruments are guitars, banjos, mandolins, balalaikas, the violin family and lutes, among others. The invention is of particular value in the case of instruments having quite long necks, as do some present designs of electric bass guitars, and therefore, the invention is shown herein in association with such an instrument, but it should be understood that the invention is not limited to this situation and that it may be used with instruments having necks of any length.

In instruments of the type mentioned, the strings pull on the outer end of the neck and tend to bend it forwardly or in such direction as to increase the spacing between the strings and the fingerboard. Conventionally, instrument necks are made of single pieces of wood and in the past various different schemes have been proposed to reinforce such neck against bending under the influence of the string tension. One well known reinforcing means consists of a steel or other metal reinforcing rod received in a longitudinally extending groove formed in the rear portion of the neck, the groove having a convex bottom surface against which the rod bears and the rod being held in tension so as to apply a force against the bottom surface of the groove tending to bend the neck in a direction opposite to the bend imposed by the strings. This type of reinforcement is quite effective in some cases, but the tension rod does add substantial weight to the instrument, which sometimes may be objectionable, and the degree of strength or stiffness added by the tension rod is also sometimes not sufficient to satisfy high quality standards. The tension rod usually has a head or other stop at one end and a nut threaded onto its other end with the wood of the neck being compressed between the head and the nut. After the strings are strung on the instrument and tensioned to their desired open string pitches, the nut of the tension rod may be adjusted to cause the tension rod to so balance the bending of the neck by the strings as to bring the spacing between the strings and the fingerboard to a desired value. However, for various reasons, such as changes in the length of the neck wood due to humidity changes, the tension rod may not hold the adjusted spacing between the strings and the fingerboard for long periods of time.

In general, the object of the invention is to provide a construction for the neck of a stringed musical instrument whereby the neck is stronger, stiffer and more rigid than previous necks. Among subsidiary advantages achieved by this improved neck strength and stiffness is the achievement of a better tone in the output of the instrument. That is, the stiffer neck results in less of the energy of a vibrating string being absorbed by the neck and, therefore, gives the tone produced by the vibrating string a longer sustain and a more constant harmonic content throughout the length of the sustain than in previous instruments. Also, the stiffer neck in addition to resisting bending of the neck by string forces also resists bending of the neck due to forces exerted on it by a musician during playing of the instrument and thereby minimizes changes in the pitch of the strings due to such bending.

Another object of the invention is to make an instrument neck of the foregoing character which is extremely stable under changes in humidity and other environmental conditions which tend to have an adverse effect on necks of previous constructions.

Another object of the invention is to provide a musical instrument neck of the foregoing character which may be made of a relatively light weight. In keeping with this object, the invention allows, if desired, the elimination of a metal tension rod in the neck and also allows the main body or portion of the neck to be made of a material, such as a low density wood or a structural foamed plastic, having a density lower than that of the wood previously conventionally used.

Another object of the invention is to provide a neck of the foregoing character including a tension rod enabling adjustment of the string-fingerboard spacing and having an improved ability to hold a given adjustment over a long period of time despite changes in humidity and other environmental conditions.

Other objects and advantages of the invention will be apparent upon reference to the following detailed description and to the drawings forming a part hereof.

SUMMARY OF THE INVENTION

This invention resides in a neck for a guitar or similar stringed musical instrument comprised of a main body part of wood, foamed structural plastic or the like and at least one elongated reinforcing member, having a high modulus of elasticity, fixed to and extending along the length of the main body. In particular, the reinforcing member has a modulus of elasticity above $12 \times 10^6$ psi. It may be made of steel or other metal, but is preferably made of a composite material consisting of high modulus of elasticity filaments, such as graphite or boron, embedded in a resin matrix. If more than one elongated reinforcing member is incorporated in the neck, then preferably two of them are spaced from one another in a direction perpendicular to the strings to achieve a sandwich structure having great resistance to bending.

The reinforcing member is so located on the main body of the neck as to be spaced from the neutral axis of the neck and fingerboard combination in the finished guitar. Therefore, bending of the neck tends to stretch or compress the reinforcing member and such bending is accordingly resisted by the high modulus of elasticity of the reinforcing member.

A reinforcing member located adjacent the forward surface of the neck body may be concealed by an overlying fingerboard and one located adjacent the rear surface of the neck body may be received in a recess in the body and concealed by an overlying insert of wood or other decorative material. Two strips of high modulus material may also be initially attached to two opposite faces of a rectangular beam of wood or other material and the whole subsequently fixed into a conforming elongated slot in the main body of the neck, or the high modulus material may be formed into the shape of an I-beam and the I-beam in turn subsequently fixed into a conforming elongated slot in the main body of the neck.

DETAILED DESCRIPTION OF THE PREFERRED EMBODIMENTS

Figure 1:
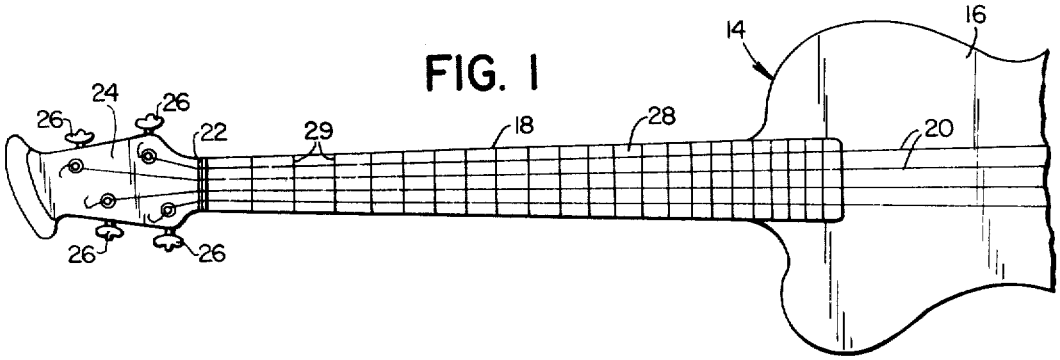
FIG. 1 is a partial plan view of an electric bass guitar having a neck embodying the present invention.
Figure 2:
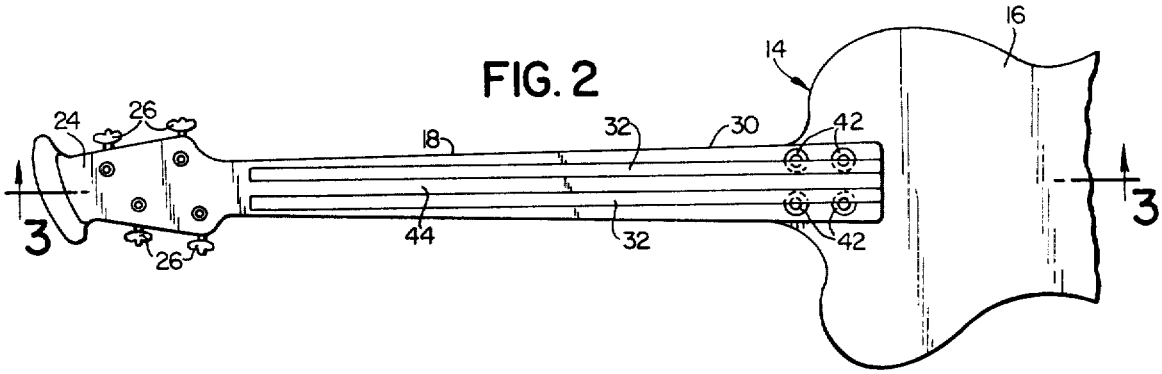
FIG. 2 is a view similar to FIG. 1 except for showing the fingerboard and strings removed from the instrument.
Figure 3:
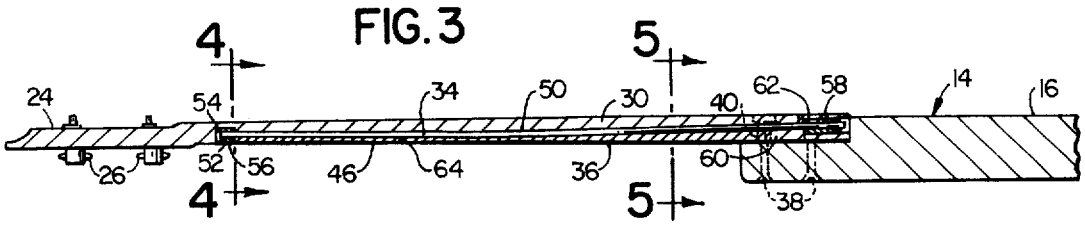
FIG. 3 is a longitudinal vertical sectional view taken on the line 3—3 of FIG. 2.
Figure 4:
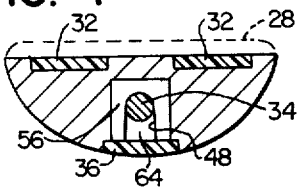
FIG. 4 is a transverse sectional view taken on the line 4—4 of FIG. 3.
Figure 5:
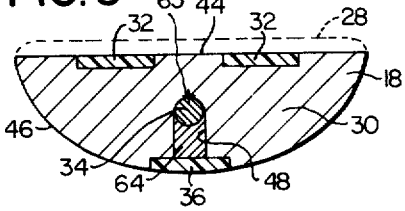
FIG. 5 is a transverse sectional view taken on the line 5—5 of FIG. 3.

Referring first to FIGS. 1 to 5, the invention is there shown embodied in a bass electric guitar 14 having a body 16 and a neck 18 extending outwardly from one end of the body. A set of strings 20, 20 are at one end of each string fixed to the body 16 by a suitable tailpiece or anchor (not shown) so as to pass over a bridge (not shown) on the body 16 and to extend along the length of the neck 18 to a nut 22 and pegboard 24 at the outer end of the neck, the pegboard including a machine head 26, one for each of the strings, to which the outer end of each string is attached, each machine head being manually adjustable to vary the tension of its associated string. The neck 18 carries a separate elongated fingerboard 28 located directly under the strings 20, 20 and itself carrying a plurality of frets 29, 29 extending transversely of the strings.

The neck 18 includes a main body 30 and a plurality of longitudinally extending reinforcing members 32, 32, 34 and 36, hereinafter described in more detail. The main body 30, except for the grooves therein which receive the reinforcing members, may be of generally conventional construction. That is, it may be a piece of mahogany or other wood cut and shaped to the desired form. However, one aspect of the invention is that because of the strength and stiffness added to the neck by the reinforcing members, the main body 30 may also be made of a material having less strength and stiffness than necessary without the reinforcing members. For example, instead of being made from a conventional type of neck wood, the main body 30 may, if desired, be made of a relatively low strength and density wood, such as pine, or from an entirely different material such as foamed urethane or other structural foamed plastic. In the illustrated case, the main body 30 of the neck is attached to the guitar body 16 by four threaded fasteners 38, 38 which pass through the guitar body and threadably engage threaded inserts or nuts 40, 40 fixed to the neck body 30 and received in counterbored recesses 42, 42. Between the pegboard 24 and its opposite or right-hand end, as viewed in FIGS. 1, 2 and 3, the neck body 30 is of a substantially D-shaped transverse section defining a generally flat longitudinally extending forward or top surface 44 and an arcuately curved rear surface 46.

Referring to FIGS. 2 to 5, the reinforcing members of the neck 18 include two strips 32, 32 of a high modulus of elasticity material located adjacent the outer surface 44 of the body 30. The strips 32, 32 are received in conforming longitudinally extending grooves in the body 30 so that the top or outer surfaces of the strips are flush with the remainder of the surface 44, and in the finished guitar, as shown in FIG. 1, they are covered and concealed by the fingerboard 28. The two strips 32, 32 are transversely spaced from one another and arranged symmetrically about the longitudinal center line of the body 30. They are firmly fixed along their entire lengths to the body 30 by an adhesive, between them and the body.

The reinforcing member 34 is a tension rod of generally conventional construction. This tension rod is loosely (non-adhesively) received in a groove 48 formed in the rear of the neck body 30 and having a convexly curved bottom surface 50, as viewed in FIG. 3, against which it bears. At its outer or left-hand end, as viewed in FIGS. 1, 2 and 3, the rod 34 has an enlarged head 52 received in a recess 54 defining an end wall 56 on the body 30 against which the head 52 bears. At its opposite or inboard end, the rod 34 is threaded to receive a nut 58 received in a recess 60 having an end wall 62 against which the nut bears. The nut 58 is tightened on the rod 34 so the rod is held in tension between the neck body end surfaces 56 and 62 and so that the rod 34 exerts a force on the bottom surface 50 of the groove 48 tending to bow the neck body upwardly as viewed in FIG. 3, that is, in the direction opposite to the bend imposed on the neck body by the string tension. Accordingly, by adjusting the nut 58 the bowing of the neck produced by the tension rod 34 may be caused to so oppose the bowing induced by the string tension as to arrive at a balanced condition for the neck wherein the spacing between the strings and the fingerboard 28 is at a desired value. Rearwardly of the tension rod 34 the groove 48 is filled by a strip 64 of wood or other filler material cemented in place by suitable glue or other adhesive.

The remaining reinforcing member 36 is a strip of high modulus of elasticity material, similar to the strips 32, 32, received in a conforming groove formed in the rear surface of the body part 30, and firmly fixed along its entire length to the body by a suitable adhesive, the groove being of such shape that the outer surface of the strip 36 is flush with the rear surface 46. The strip 36 is centered on the longitudinal center line of the body part 30 and overlies the filler strip 64 in the groove 48.

The strips 32, 32 and 36 are made of a material having a modulus of elasticity of $12 \times 10^6$ psi, or higher. They may be made of steel or other metal with a modulus of elasticity of $12 \times 10^6$ psi or higher. Preferably, however, they are made of a composite material consisting of high modulus of elasticity filaments embedded in a resin matrix. Further, the modulus of elasticity of the filaments of such composite material is greater than $28 \times 10^6$ psi. Filaments having such high modulus of elasticity and suitable for use in the reinforcing strips include boron filaments, graphite filaments and steel filaments. The resin matrix may be either an epoxy resin or a polyester resin. Preferably, the strips are made and cured, as by a pulltrusion process, apart from the neck body 30 and are fixed in their associated grooves to the body 30 by a suitable adhesive such as a room curing resin system. This is, however, not necessary and the strips may be assembled with the body 30 in other ways. For example, the strips 32, 32 may initially be in the form of so-called preimpregnated strips consisting of filaments in a matrix of uncured resin. These preimpregnated strips are placed in the associated grooves of the neck body and cured in place with the resin of the preimpregnated strips also serving to bond or cement the resulting cured strips to the neck body. As another alternative, the strips 32, 32 and 36 may be formed by first partially filling their grooves in the neck body with uncured resin, adding filaments to the resin and then curing the resin in place.

The two forward reinforcing strips 32, 32 are located in a common plane which is spaced in the direction perpendicular to the strings from the rear reinforcing strip 36. Therefore, these strips form a sandwich construction consisting of the strips 32, 32 on one side, the strip 36 on the other side and the wood of the neck body in the middle to produce a strong resistance to bending of the neck about an axis parallel to the front surface 44 and perpendicular to the longitudinal axis of the neck. Also, the neutral bending axis 65 of the neck and fingerboard in combination (that is, the axis along which the material of the neck is neither in tension nor compression as the neck is bent, as by string forces, in a plane parallel to the neck and perpendicular to the face of the fingerboard) is spaced from all three of the strips so that when a bending force is applied to the neck, it tends to either shorten or stretch each strip which shortening or stretching is resisted by the high modulus of elasticity of the strips. The resistance to bending provided by the strips is sufficiently great in comparison to the strength of the wood or other material from which the neck body 30 is made that the changes in the stress of the wood or other material of the neck body due to humidity or other environmental conditions are relatively insignificant and have little effect on bending of the neck. The tension rod 34 is, however, capable of exerting a large bending force on the neck body and, therefore, by adjusting it slight changes in the neck bend may be made to control the string to fingerboard spacing. Once such adjustment is made, it will be held over long periods of time despite changes in humidity and the like due to the strength and stability of the material of the reinforcing strips 32, 32 and 36.

Strips of composite or other high modulus of elasticity material either in combination with or not in combination with a tension rod may be used in various different arrangements in accordance with the broader aspects of this invention. By way of example, FIGS. 6 to 15 show various other embodiments of the invention different from that shown by FIGS. 1 to 5. Most of these figures are cross-sectional views similar to FIG. 5 and it will be understood that in each case the main body of the neck is generally similar to the main body 30 of FIGS. 1 to 5 and that the reinforcing members extend longitudinally of and are adhesively fixed to the main body in the same manner as the reinforcing members of FIGS. 1 to 5. In each of FIGS. 6 to 15 the main body of the neck has for convenience been indicated by the reference numeral 30 even though it differs slightly from the part 30 of FIGS. 1 to 5 in regard to its grooves for receiving the reinforcing members.

Figure 6:
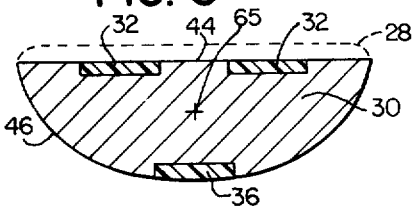
FIG. 6 is a view similar to FIG. 5 but showing an alternative embodiment of the invention.

Referring next to FIG. 6, the neck there shown is similar to that of FIGS. 1 to 5 except for omitting the tension rod 34. That is, in this case, the neck consists only of the body part 30 and the strips 32, 32 and 36 of high modulus of elasticity material.

Figure 7:
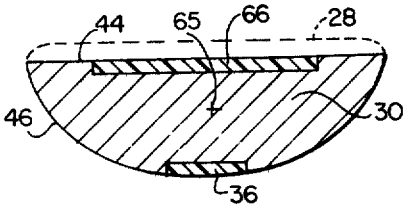
FIG. 7 is a view similar to FIG. 5 but showing still another alternative embodiment of the invention.

In the embodiment of FIG. 7, the neck is similar to that of FIG. 6 except for the two separate strips 32, 32 of high modulus of elasticity material adjacent the forward surface 44 of the body 30 being replaced by a single wider strip 66 of such material.

Figure 8:
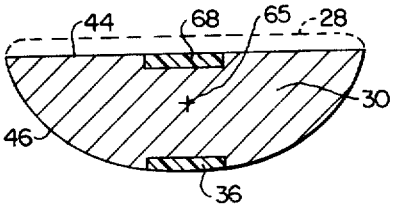
FIG. 8 is a view similar to FIG. 5 but showing still another alternative embodiment of the invention.

In the embodiment of FIG. 8 the construction is similar to that in FIG. 7 except that the single forward strip 66 of high modulus of elasticity material is replaced by a narrower strip 68 of such material having substantially the same dimensions as the rear strip 36.

Figure 9:
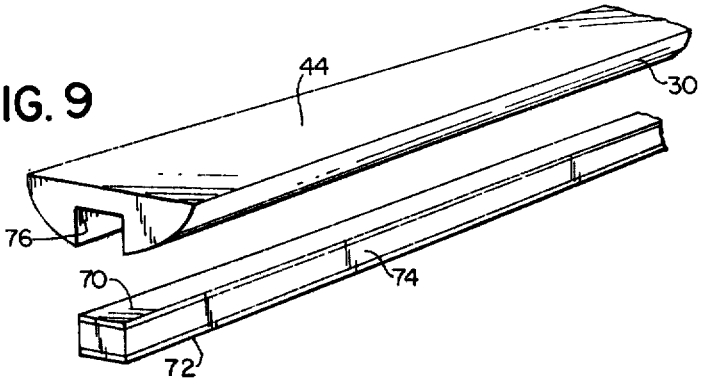
FIG. 9 is fragmentary exploded perspective view of a stringed instrument neck comprising still another embodiment of this invention.
Figure 10:
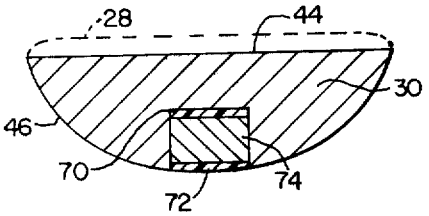
FIG. 10 is a transverse sectional view similar to FIG. 5 but showing the embodiment of FIG. 9.

In the embodiment of FIGS. 9 and 10, the neck includes two strips 70 and 72 of high modulus of elasticity material generally similar to the strips 68 and 36 of FIG. 8. The construction differs from that of FIG. 8 primarily in the way the reinforcing strips 70 and 72 are fixed to the neck body 30. In particular, prior to assembly with the body 30 the strips 70 and 72 are bonded to opposite faces of an elongated beam 74 of wood or other similar material. The beam 74 with the strips 70 and 72 attached is then inserted into a conforming groove 76 formed in the rear of the neck body 30 and fixed in place relative to the body 30 by a suitable cement or adhesive. The relative sizes of the groove 76 and other parts is such that in the finished product, as shown in FIG. 10, the outer surface of the strip 72 is flush with the rear surface 46 of the neck.

Figure 11:
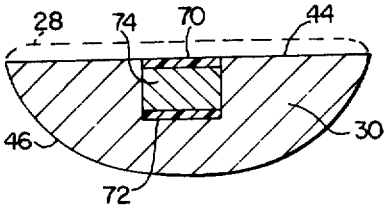
FIG. 11 is a transverse sectional view similar to FIG. 5 but showing still another embodiment of the invention.

In the embodiment of FIG. 11, the construction is similar to that of FIG. 10 except that the beam 74 and its attached strips 70 and 72 are received in a recess opening onto the forward surface 44 of the neck body 30 rather than onto the rear surface 46. The relative dimensions of the part is such that the top surface of the strip 70 is flush with the forward surface 44 of the body 30. This construction has the advantage that when the fingerboard 28 is in place, the reinforcing system is entirely concealed from view and the neck may be otherwise finished to resemble from all outward appearances a conventional unreinforced neck.

Figure 12:
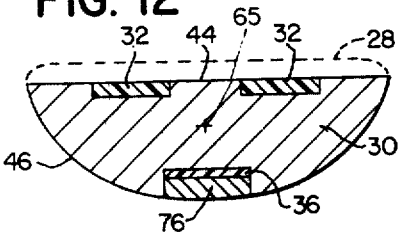
FIG. 12 is a view similar to FIG. 5 but showing still another embodiment of the invention.

The embodiment of the invention shown in FIG. 12 is similar to that of FIG. 6 except that the rear reinforcing strip 36 is placed in a slightly deeper groove in the rear of the neck body 30 and the outer portion of the groove, after the reinforcing strip 36 is in place, is filled with a filler strip 76 of wood or other material to conceal the strip 36.

Figure 13:
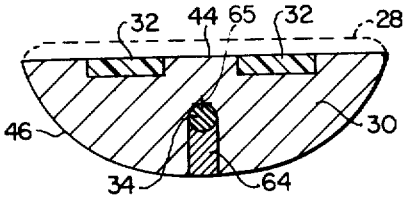
FIG. 13 is a view similar to FIG. 5 but showing still another embodiment of the invention.

In the embodiment of FIG. 13 the construction of the neck is similar to that of FIGS. 1 to 5 except that the strip 36 of reinforcing material is omitted so that the tension rod 34 serves as the sole rear reinforcing member.

Figure 14:
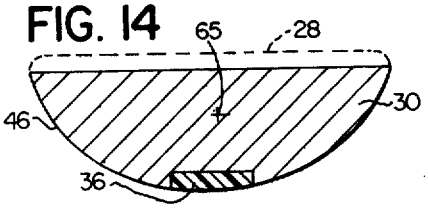
FIG. 14 is a view similar to FIG. 5 but showing still another embodiment of the invention.

In the embodiment of FIG. 14 the construction of the neck is similar to that of FIG. 6 except that the two forward reinforcing strips 32, 32 are omitted so that the rear strip 36 serves as the sole reinforcing member. The strip 36 is, however, spaced a substantial distance from the neutral bending axis 65. Therefore, due to the strip being fixed to the neck body 30, forces tending to bend the neck will also tend to lengthen or shorten the strip and will accordingly be resisted by the strip because of its high modulus of elasticity.

Figure 15:
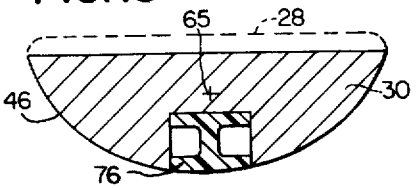
FIG. 15 is a view similar to FIG. 5 but showing still another embodiment of the invention.

In the embodiment of FIG. 15 the construction of the neck is similar to that of FIG. 10 except that, instead of a reinforcing beam made up of two strips of high modulus of elasticity material bonded to an intermediate beam of wood or the like, the reinforcing member is a beam 76, of I-beam cross section, made entirely of high modulus of elasticity material and fixed by suitable adhesive to the neck body 30.

I claim:

1. In a stringed musical instrument the combination comprising: a neck having an elongated body with a generally flat forward surface extending longitudinally thereof and a transversely curved rear surface also extending longitudinally thereof, a fingerboard attached to said neck body and overlying said generally flat forward surface thereof, and an elongated reinforcing member extending longitudinally of said neck body and fixed relative thereto, said reinforcing member being made of a composite material consisting of filaments of a material having a modulus of elasticity of over $28 \times 10^6$ psi embedded in a resin matrix, and said reinforcing member being spaced in the direction perpendicular to said forward surface from the neutral bending axis of said neck body and fingerboard in combination with regard to bending of said neck body in a plane parallel to the longitudinal axis of said neck body and perpendicular to said forward surface.

2. The combination defined in claim 1 further characterized by said reinforcing member being fixed to said neck body along substantially its entire length by an adhesive.

3. The combination defined in claim 1 further characterized by said reinforcing member having an I-beam cross section.

4. The combination defined in claim 1 further characterized by said reinforcing member being made of a composite material consisting of filaments selected from the class consisting of graphite filaments, boron filaments and steel filaments embedded in a resin matrix.

5. The combination defined in claim 1 further characterized by said reinforcing member being received in a groove formed in said forward surface of said neck body.

6. The combination defined in claim 1 further characterized by said reinforcing member being received in a groove formed in said rear surface of said neck body.

7. The combination defined in claim 1 further characterized by a said neck body having an opening passing longitudinally therethrough, and a tension rod loosely received in said opening, said tension rod having two stops located respectively at its two ends engageable with said neck body to hold said rod in tension.

8. A reinforced neck for a stringed musical instrument, said neck comprising an elongated body having a generally flat forward surface extending longitudinally thereof and a transversely curved rear surface also extending longitudinally thereof, and at least two elongated reinforcing members extending longitudinally of said body and fixed relative thereto, said two reinforcing members being spaced from one another in the direction perpendicular to said forward surface, each of said reinforcing members being made of a composite material consisting of filaments of a material having a modulus of elasticity of over $28 \times 10^6$ psi embedded in a resin matrix.

9. A reinforced neck for a stringed musical instrument as defined in claim 8 further characterized by there being three of said reinforcing members, one of said three reinforcing members being received in a groove formed in said rear surface of said neck body and the other two of said three members being located respectively in two laterally spaced grooves in said forward surface of said neck body.

10. A reinforced neck for a stringed musical instrument as defined in claim 8 further characterized by each of said reinforcing members being fixed to said neck body along substantially its entire length by an adhesive.

11. A reinforced neck for a stringed musical instrument as defined in claim 8 further characterized by each of said reinforcing members being made of a composite material consisting of filaments selected from the class consisting of graphite filaments, boron filaments and steel filaments embedded in a resin matrix.

12. A reinforced neck for a stringed musical instrument as defined in claim 9 further characterized by one of said two reinforcing members being received in a groove formed in said forward surface of said neck body and the other of said two reinforcing members being received in a groove formed in said rear surface of said neck body.

13. A reinforced neck for a stringed musical instrument as defined in claim 12 further characterized by said neck body having an opening passing longitudinally therethrough, and a tension rod loosely received in said opening, said tension rod having two stops located respectively at its two ends engageable with said neck body to hold said rod in tension.

14. A reinforced neck for a stringed musical instrument, said neck comprising an elongated body having a longitudinally extending groove therein, and an elongated reinforcing member received in said groove and fixed to said body, said reinforcing member being made at least in part of a composite material consisting of filaments of a material having a modulus of elasticity of over $28 \times 10^6$ psi embedded in a resin matrix.

15. A reinforced neck for a stringed musical instrument as defined in claim 14 further characterized by said reinforcing member being made entirely of said composite material.

16. A reinforced neck for a stringed musical instrument as defined in claim 15 further characterized by said reinforcing member being a strip having a substantially rectangular cross section.

17. A reinforced neck for a stringed musical instrument as defined in claim 15 further characterized by said reinforcing member having an I-beam cross section.

18. A reinforced neck for a stringed musical instrument as defined in claim 14 further characterized by said reinforcing member being a beam comprised of two strips of said composite material bonded to opposite faces of an intermediate beam of a different material.

19. A reinforced neck for a stringed musical instrument as defined in claim 14 further characterized by said reinforcing member being bonded along its entire length to said neck body.

* * * * *